US009057513B2

(12) United States Patent
Lindblom et al.

(10) Patent No.: US 9,057,513 B2
(45) Date of Patent: Jun. 16, 2015

(54) ELECTRICAL ASSEMBLY FOR CONNECTING COMPONENTS OF A LIGHTING SYSTEM FOR ILLUMINATING STORE SHELVING

(71) Applicant: Streater LLC, Albert Lea, MN (US)

(72) Inventors: Thomas G. Lindblom, Claremont, MN (US); Wayne Lee Jensen, Ellendale, MN (US)

(73) Assignee: Streater LLC, Albert Lea, MN (US)

( * ) Notice: Subject to any disclaimer, the term of this patent is extended or adjusted under 35 U.S.C. 154(b) by 128 days.

(21) Appl. No.: 14/027,704

(22) Filed: Sep. 16, 2013

(65) Prior Publication Data

US 2015/0079823 A1 Mar. 19, 2015

(51) Int. Cl.

| | |
|---|---|
| ***H01R 25/00*** | (2006.01) |
| ***F21V 21/34*** | (2006.01) |
| ***H01R 13/58*** | (2006.01) |
| ***H01R 25/14*** | (2006.01) |

(52) U.S. Cl.

CPC ..... *F21V 21/34* (2013.01); *H01R 13/582* (2013.01); *H01R 25/14* (2013.01)

(58) Field of Classification Search

CPC ..... H01R 25/145; H01R 13/26

USPC ..... 439/699.1, 115, 201

See application file for complete search history.

(56) References Cited

U.S. PATENT DOCUMENTS

| | | | | | |
|---|---|---|---|---|---|
| 2,510,944 | A * | 6/1950 | Auerbach | 439/378 |
| 2,598,862 | A * | 6/1952 | Tonn | 439/374 |
| 2,674,723 | A * | 4/1954 | Hurlbut | 439/699.1 |
| 2,755,452 | A * | 7/1956 | Rogie | 439/699.1 |
| 3,605,064 | A * | 9/1971 | Routh et al. | 439/115 |
| 3,622,938 | A * | 11/1971 | Ito et al. | 439/115 |
| 4,018,497 | A * | 4/1977 | Bulanchuk | 439/115 |
| 4,042,291 | A * | 8/1977 | Moriyama | 439/210 |
| 4,245,874 | A * | 1/1981 | Bishop | 439/94 |
| 4,886,462 | A * | 12/1989 | Fierro | 439/79 |
| 4,973,796 | A * | 11/1990 | Dougherty et al. | 174/495 |
| 5,154,641 | A * | 10/1992 | McLaughlin | 439/620.26 |
| 5,348,485 | A * | 9/1994 | Briechle et al. | 439/110 |
| 5,476,396 | A * | 12/1995 | De Castro | 439/692 |
| 5,639,258 | A * | 6/1997 | Clark | 439/404 |
| 6,093,037 | A * | 7/2000 | Lin | 439/115 |
| 6,527,565 | B1 * | 3/2003 | Johns | 439/116 |
| 8,545,045 | B2 * | 10/2013 | Tress | 362/217.17 |
| 8,939,779 | B1 * | 1/2015 | Lindblom et al. | 439/121 |
| 8,979,296 | B2 * | 3/2015 | Wiemer et al. | 362/125 |
| 2014/0055978 | A1 * | 2/2014 | Gantz et al. | 362/8 |
| 2014/0224875 | A1 * | 8/2014 | Slesinger et al. | 235/385 |
| 2015/0079823 | A1 * | 3/2015 | Lindblom et al. | 439/110 |

* cited by examiner

*Primary Examiner* — Neil Abrams

(74) *Attorney, Agent, or Firm* — Nikolai & Mersereau, PA; Thomas J. Nikolai

(57) ABSTRACT

Quick-connect disconnect connectors are provided as part of an electrical assembly used to electrically couple components to the end of an electrical track section. The connectors have a tongue portion insertable into the end of the track only one way to ensure against cross-wiring and include structures for retaining electrical contacts and strain reliefs. The connectors readily disconnect from the end of the track when force is applied which might be sufficient to damage the track or electrical assembly to prevent such damage.

20 Claims, 11 Drawing Sheets

ELECTRICAL ASSEMBLY FOR CONNECTING COMPONENTS OF A LIGHTING SYSTEM FOR ILLUMINATING STORE SHELVING

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to lighting systems for display cases and shelving units used by merchants. More specifically, the present invention relates to quick-connect and disconnect connectors forming a part of such lighting systems which ensure that no cross-wiring occurs during the assembly process.

II. Related Art

Various forms of lighting have been employed in retail establishments. Lighting is used on signage, to provide security, to accent and better display product features, to enhance the prominence and attractiveness of merchandise, and to affect the mood of customers. The eye is drawn to brighter areas of contrasting light. Reading of packaging and labeling is easier in well lighted areas.

Many retail establishments employ overhead ambient light sources and shelving units for holding merchandise. The shelving units incorporate a plurality of vertically arranged shelves. These shelves are relatively deep and opaque such that the shelves of the shelving unit cast shadows upon or otherwise limit light from reaching merchandise stored on all but the top shelf of the shelving unit. Further, such lighting and shelving units are bland and do not serve to "catch the eye" of the retail customer and do little to attract a customer to a particular item of merchandise.

Various lighting systems for shelving units have been employed to overcome these deficiencies, but they are often costly, laborious to assemble, and involve numerous electrical connections which must be made after the shelving unit is completely assembled. Further, such electrical connections typically must be taken apart before the shelving unit can be disassembled to prevent damage to the shelves, light fixtures or electrical contacts. Substantial skill and effort is required to assemble and disassemble such prior art lighting systems. If sufficient care is not exercised, such prior art lighting systems increase the risk of electrical shock or even fire. Substantial routing of wires from light fixtures to sources of electricity is required. One undesirable aspect of many such lighting systems is that, after installation, dangling wires detract from achieving the desired effect. The need therefore exists for wiring harnesses and connectors that overcome these deficiencies.

SUMMARY OF THE INVENTION

The present invention is used in conjunction with shelving units which comprise a base, one or more back members extending vertically from the base, and at least one shelf secured to the back members and extending normally therefrom. Typically, the shelving units include a plurality of shelves supported by the back members in spaced, vertical arrangement. The present invention concerns electrical assemblies such as wiring harnesses and connectors used to install lighting systems on such shelving units. More specifically, the electrical assemblies are used to couple electrical devices to a lighting track secured to the back members of the shelving unit and extending vertically from the base of the shelving unit toward the top of the shelving unit. The track has a channel and elongated opening running the length thereof and exposing the channel. Inside the channel, on opposite sides are two parallel conductors running substantially the length of the channel. One of the conductors serves as a positive conductor and the other conductor serves as a negative conductor.

The wiring harnesses and connectors of the present invention are used to connect a power supply to the track. The connectors may also be used to connect light fixtures mounted to the underside of the individual shelves to the track. The connectors and wiring harnesses are also suitable for joining sections of the track together. The harnesses and connectors are also used to couple multiple electronic devices to the track.

The connectors associated with the wiring harnesses are designed to ensure proper polarity of the wiring is maintained (i.e., the negative terminals are connected to the negative side of the circuit and the positive terminals are connected to the positive side of the circuit). Also, the connectors are all designed so they are quickly connected and held in place for use. However, when shelving is disassembled or individual shelves are moved, the wiring harness automatically disconnects from either the track or the electrical device (e.g., a power supply or light fixture) to prevent damage to the track, the wiring harness, and the electrical device.

BRIEF DESCRIPTION OF THE DRAWINGS

The foregoing features, objects and advantages of the invention will become apparent to those skilled in the art from the following detailed description and with reference to the following drawings in which like numerals and the several views refer to corresponding parts.

DETAILED DESCRIPTION

Figure 1:
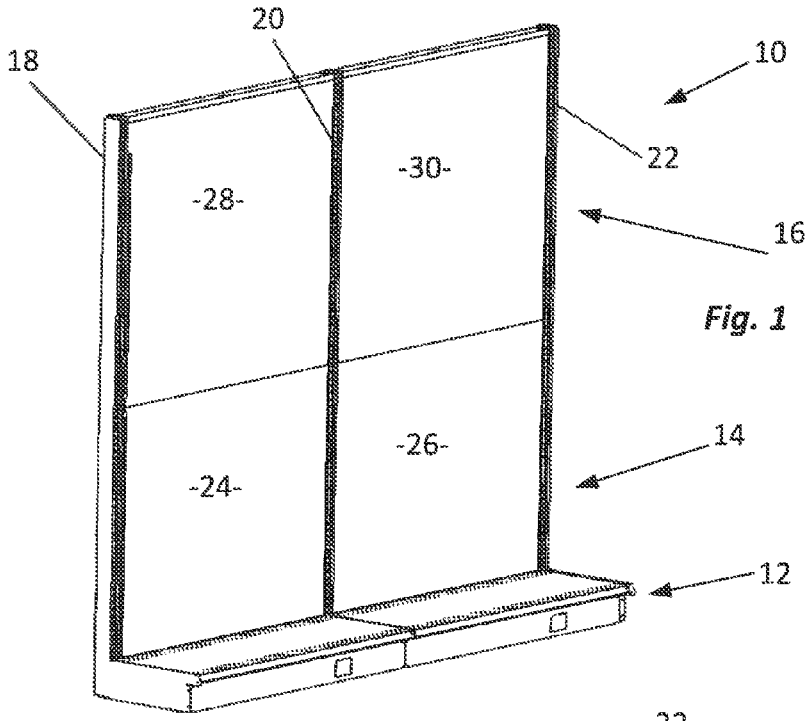
FIG. 1 illustrates the base and back members of a shelving unit.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", as well as derivative thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

Figure 2:
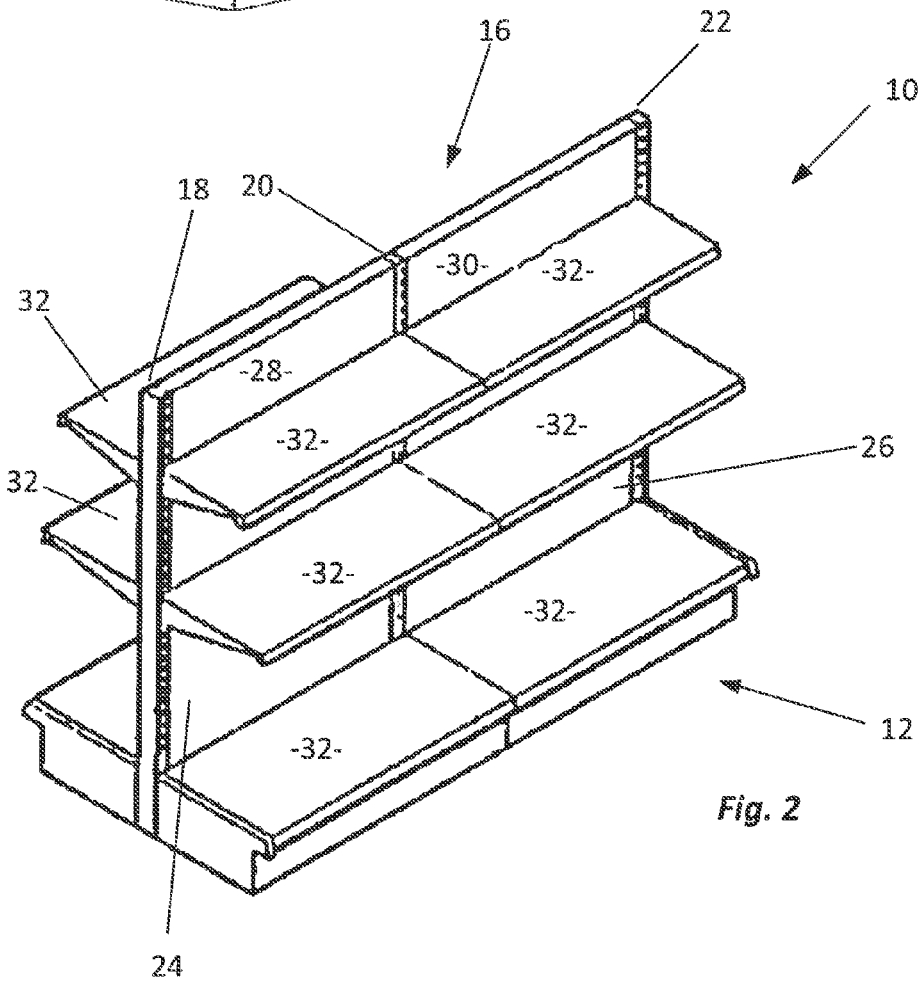
FIG. 2 illustrates a plurality of shelves attached to the base and hack unit of a shelving unit.

FIGS. 1 and 2 illustrate gondola-type shelving units 10. The gondola-type shelving unit 10 has a base 12, a lower back section 14, and an upper back section 16. The gondola-type shelving unit 10 also includes three vertical support members 18, 20 and 22 extending upwardly from the base 12. The lower back section 14 includes a pair of panels 24 and 26 while the upper back section 16 includes panels 28 and 30. As shown in FIG. 2, a plurality of shelves 32 are attached to and extend outwardly from the vertical support rails 18-22.

Figure 3:
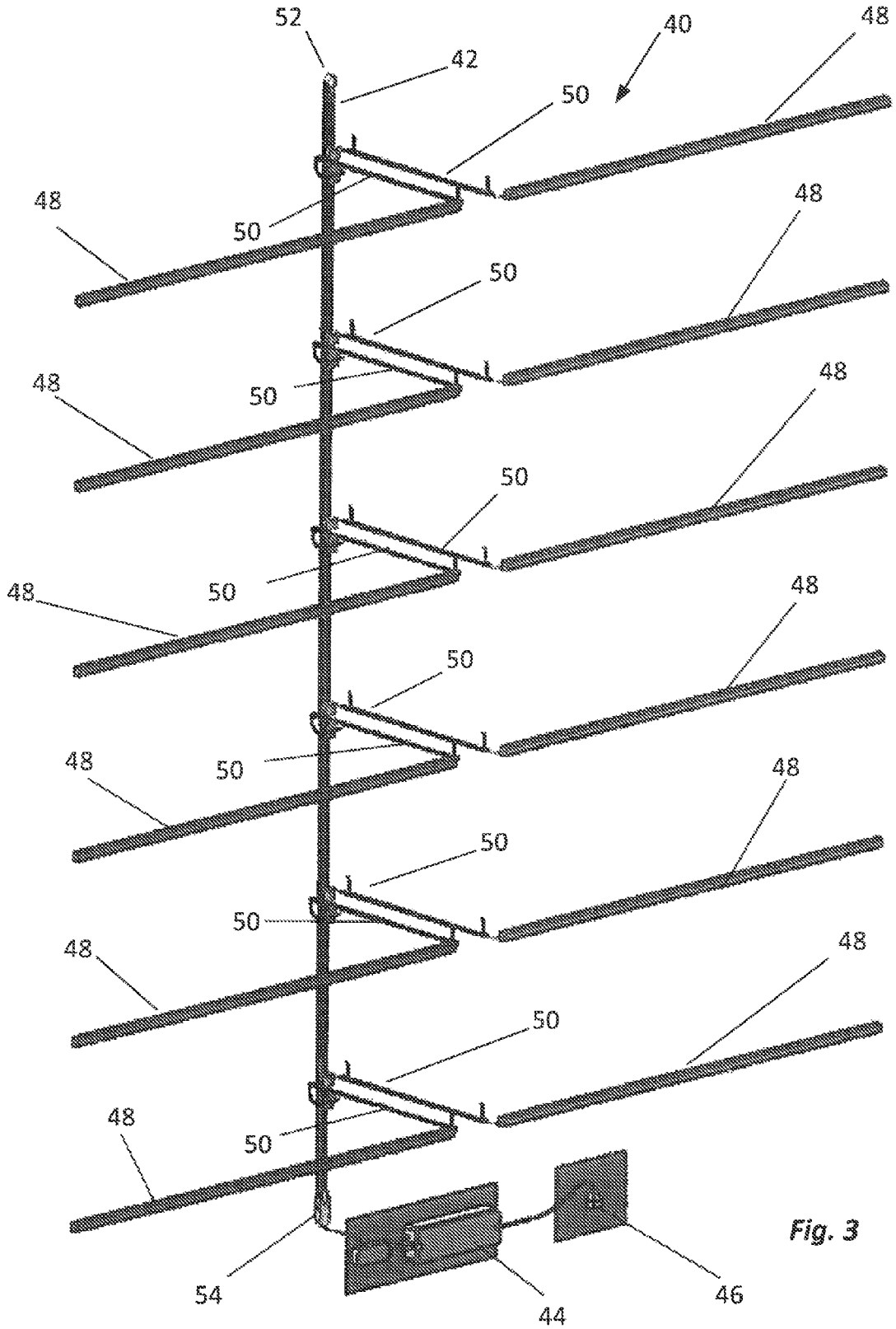
FIG. 3 illustrates a lighting system which may be used with the shelving units of FIGS. 1 and 2.

FIG. 3 shows a lighting assembly 40 particularly well suited for use with gondola-type shelving of the type shown in FIGS. 1 and 2. The lighting assembly 40 includes a track 42 which is coupled to a power supply 44 which, in turn, is coupled to an electrical outlet 46. As such, the track 42 is energized by the power supply 44 and electrical outlet 46. Also shown in FIG. 3 is a plurality of light sources 48. Each light source 48 is intended to be coupled to the bottom of one of the shelves 32 near the front edge of the shelf. FIG. 3 also shows wiring harnesses 50 coupling the light fixtures 48 to the track 42. FIG. 3 also shows an end cap 52 covering the top end of the track and a wiring harness 54 which couples the track to the power supply. The present invention provides improvements to the electrical assemblies in the form of wiring harnesses such as 50 and 54 shown in FIG. 3.

Figure 4:
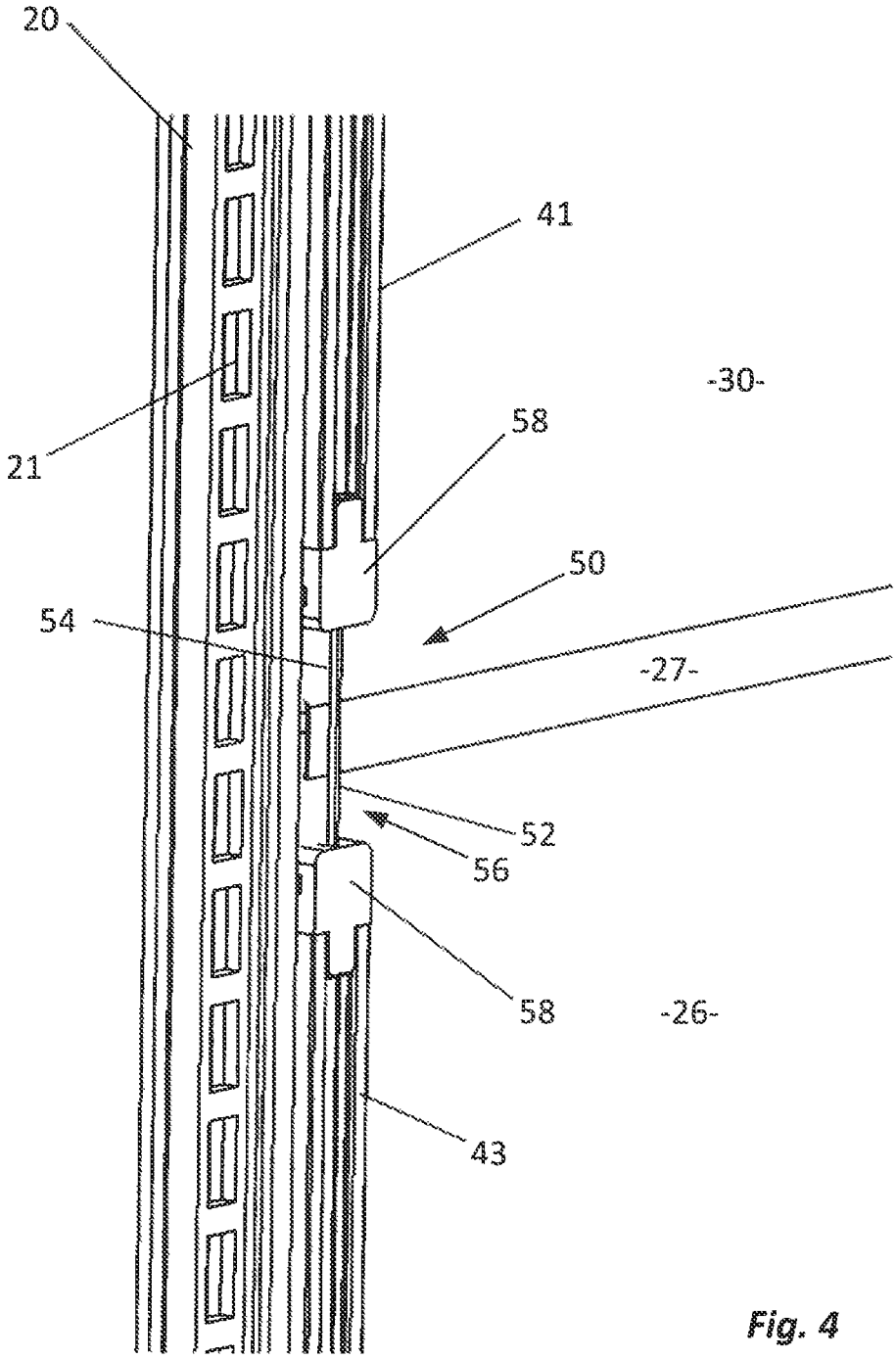
FIG. 4 illustrates a back member of the shelving unit of FIG. 1 or 2 together with a pair of lighting tracks joined together by a harness incorporating connectors of the present invention.
Figure 5:
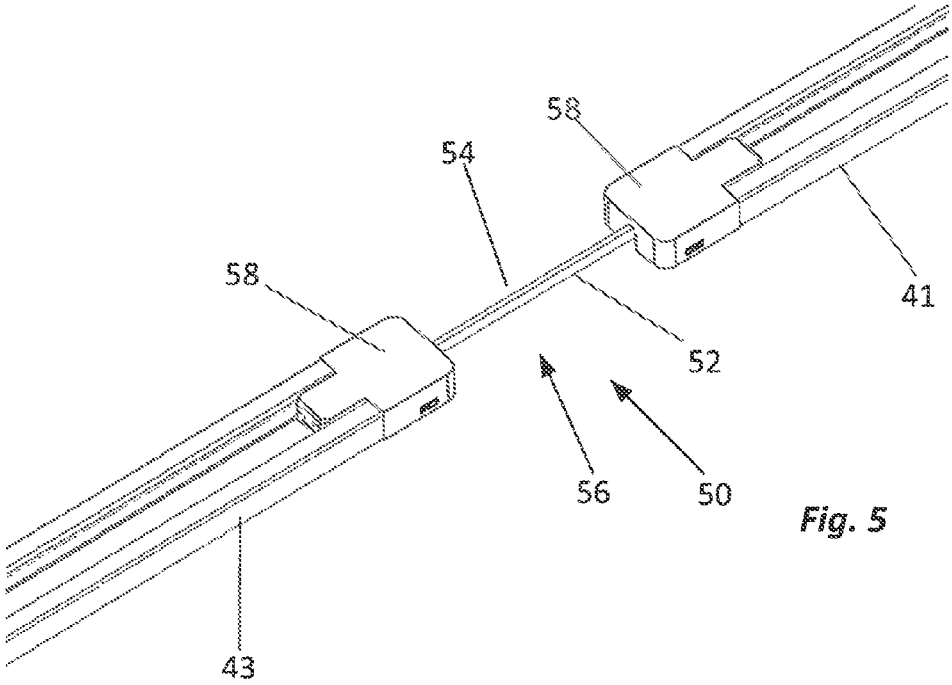
FIG. 5 shows two pieces of track joined together by the harness of FIG. 4.
Figure 6:
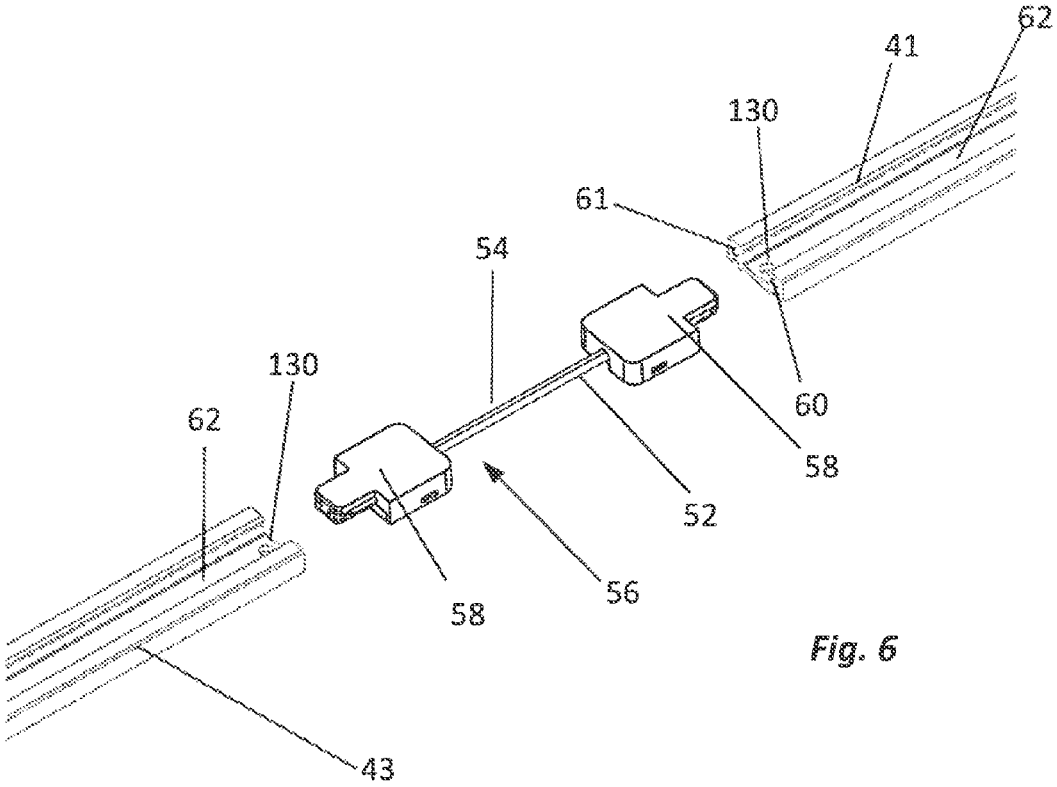
FIG. 6 shows the same two pieces of track as in FIG. 5 but with the harness removed, from the track.
Figure 7:
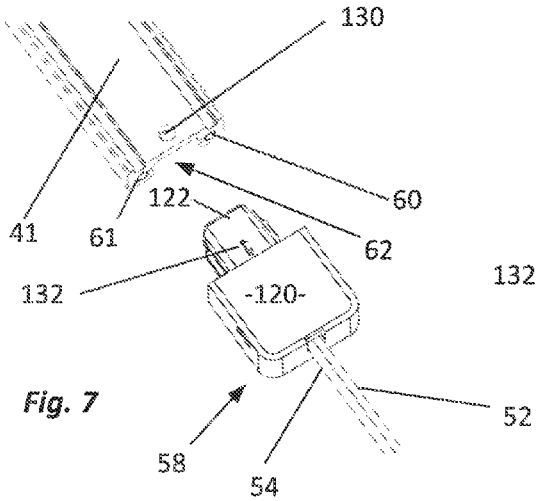
FIG. 7 shows a connector of a harness of the present invention aligned to be inserted in a section of track from the back side of the track.
Figure 8:
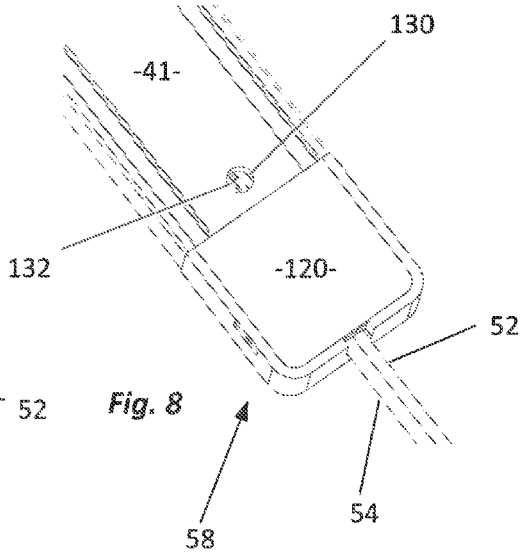
FIG. 8 shows the arrangement of FIG. 7 with the connector inserted into the track.
Figure 9:
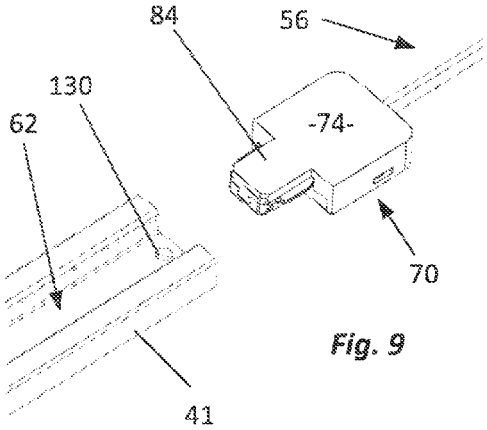
FIG. 9 shows a section of track with a connector of the wiring harness aligned for insertion into the track from the front side of the track.
Figure 10:
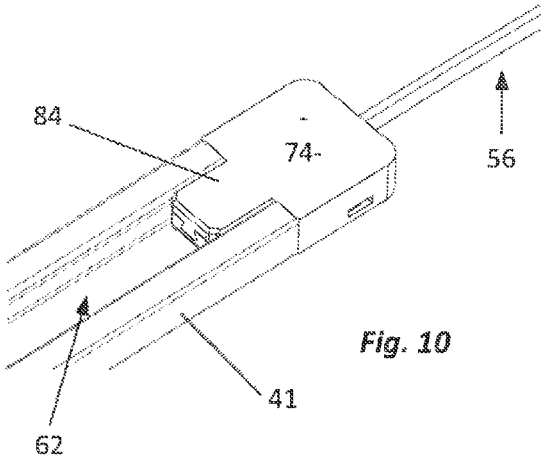
FIG. 10 shows the arrangement of FIG. 9 with the connector inserted, into the track.
Figure 11:
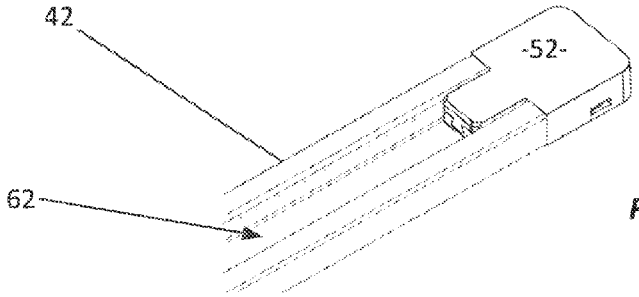
FIG. 11 shows a track section coupled to an end cover having substantially the same design as the housing of the track connector of the present invention.
Figure 12:
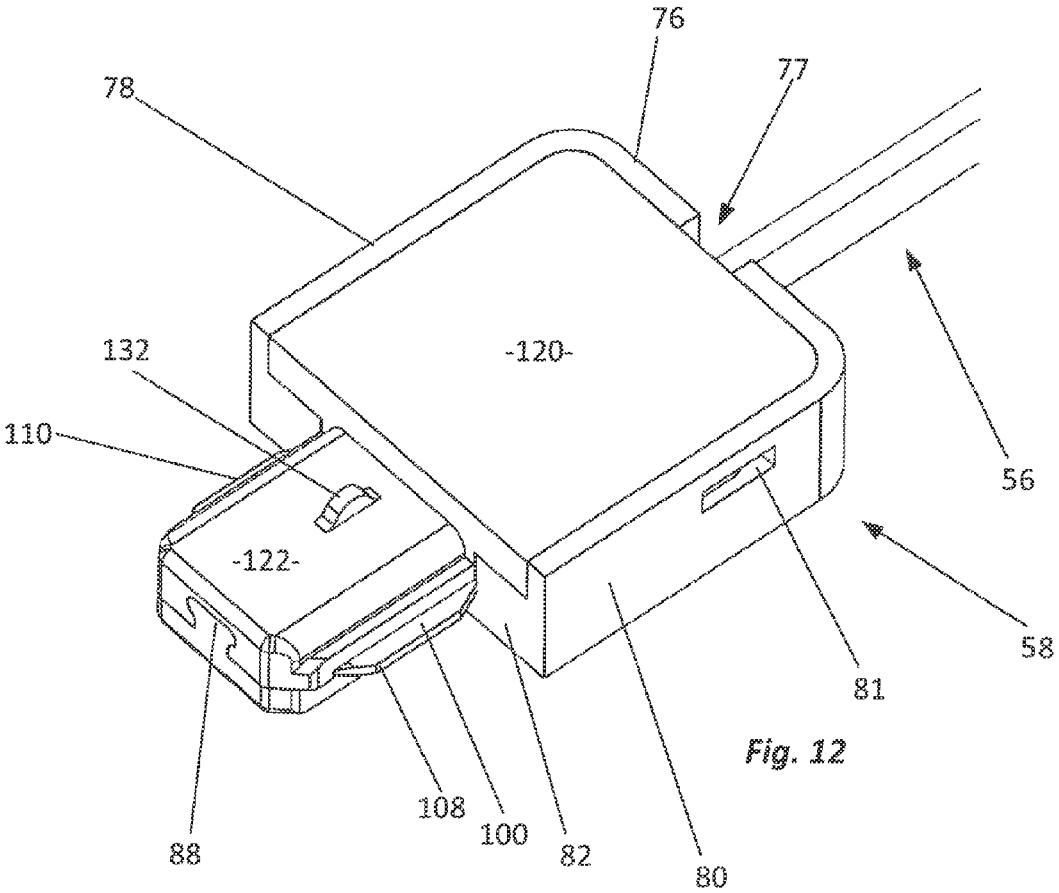
FIG. 12 is a perspective view showing the hack of the connector of the present invention.
Figure 13:
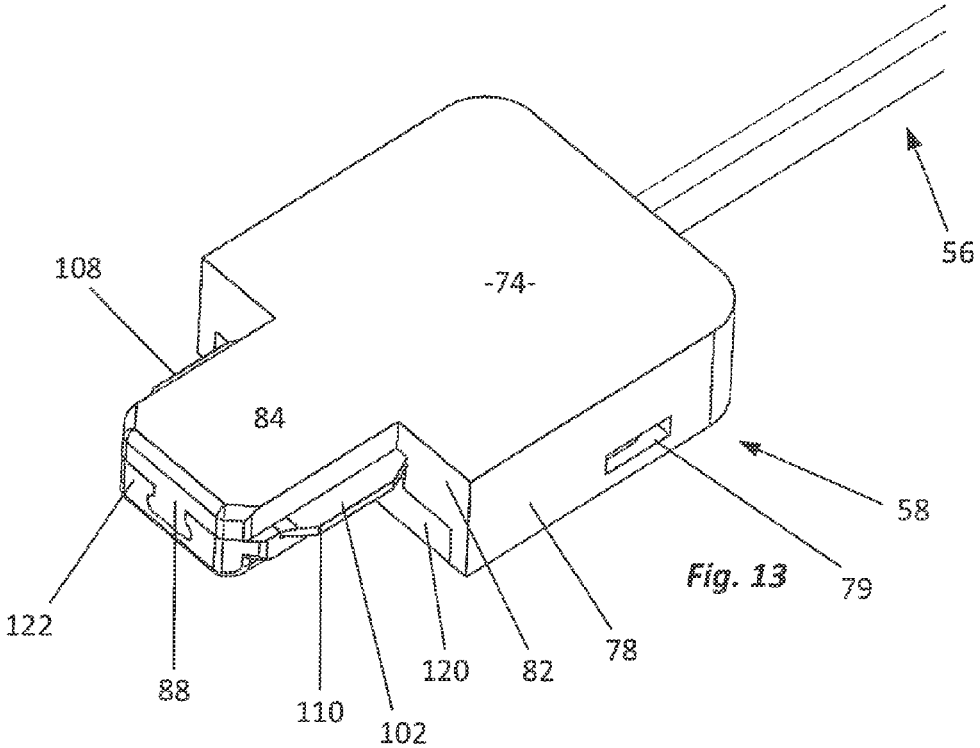
FIG. 13 is a perspective view showing the front of the connector of the present invention.

One such improved electrical assembly is shown in FIGS. 4-6. Visible in FIG. 4 is a vertical support rail 20 which includes a plurality of slots 21 used to couple the shelves 32 to the vertical support rail. Also shown in FIG. 4 are the upper and lower back panels 30 and 26 as well as a coupling member 27 used to join the edges of the back panels 26 and 30 together. Attached adjacent to the top back panel 30 and the vertical support 20 is a first track portion or section 41 of track 42. Attached adjacent back panel 26 and, vertical support 20 is a second track portion or section 43 of track 42. During assembly, the upper track portion 41 is secured to panel 30 and the lower track portion 43 is secured to panel 26. However, this leaves a physical gap between the track portions 41 and 43 and no electrical connection between the conductors residing within these track portions.

To close the gap and provide such an electrical connection, wiring harness 50 is provided. The wiring harness 50 includes a positive insulated conductor 52 and a negative insulated conductor 54 which together comprise a 2-wire cable 56. Attached to opposite ends of cable 56 are connectors 58. These connectors are designed to mate with the open ends of the track sections 41 and 43 such that the wiring harness provides an electrical connection between the negative conductors within track portions 41 and 43 and, an electrical connection between the positive conductors located within the track portions 41 and 43. More specifically, and as better illustrated in FIG. 6, the track portions 41 and 43 include a pair of electrical conductors 60 and 61 located on opposite sides of a channel 62. The channel 62, as well as the two electrical conductors 60 and 61, runs the length of the track sections 41 and 43. The connectors 58 mate with the open ends of the track portions 41 and 43 as illustrated in FIGS. 4 and 5.

FIGS. 7-17 provide greater details concerning the construction of the assembly 50 and the features of the connectors 58 which provide quick connect and quick disconnect functionality while at the same time ensuring that cross-wiring does not occur.

Figure 14:
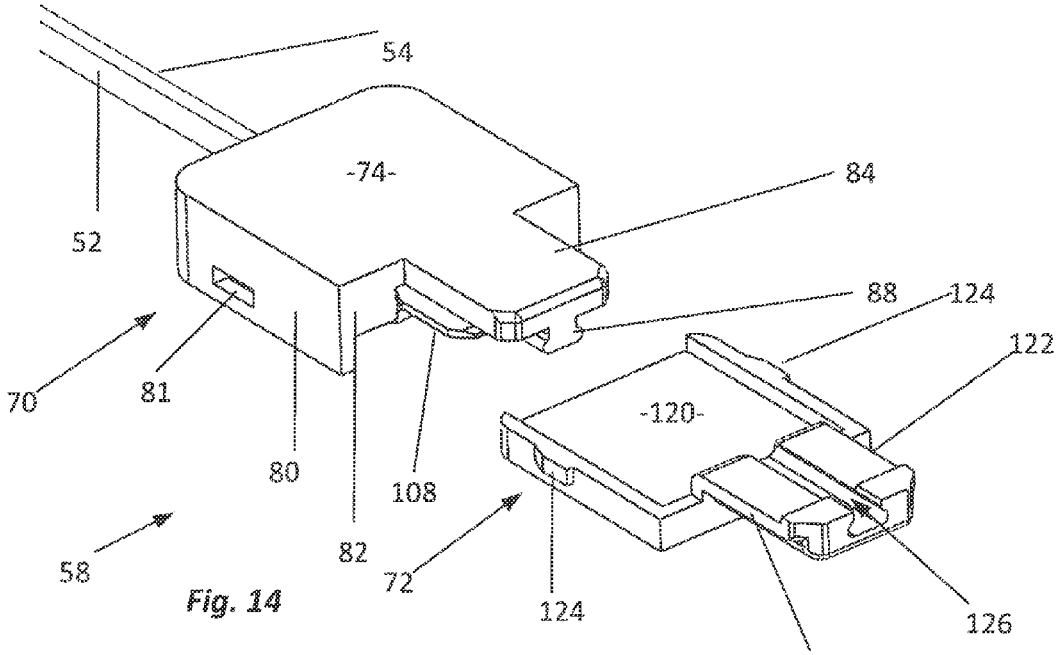
FIG. 14 is a perspective view showing the housing of the connector disassembled from the cover of the connector.
Figure 15:
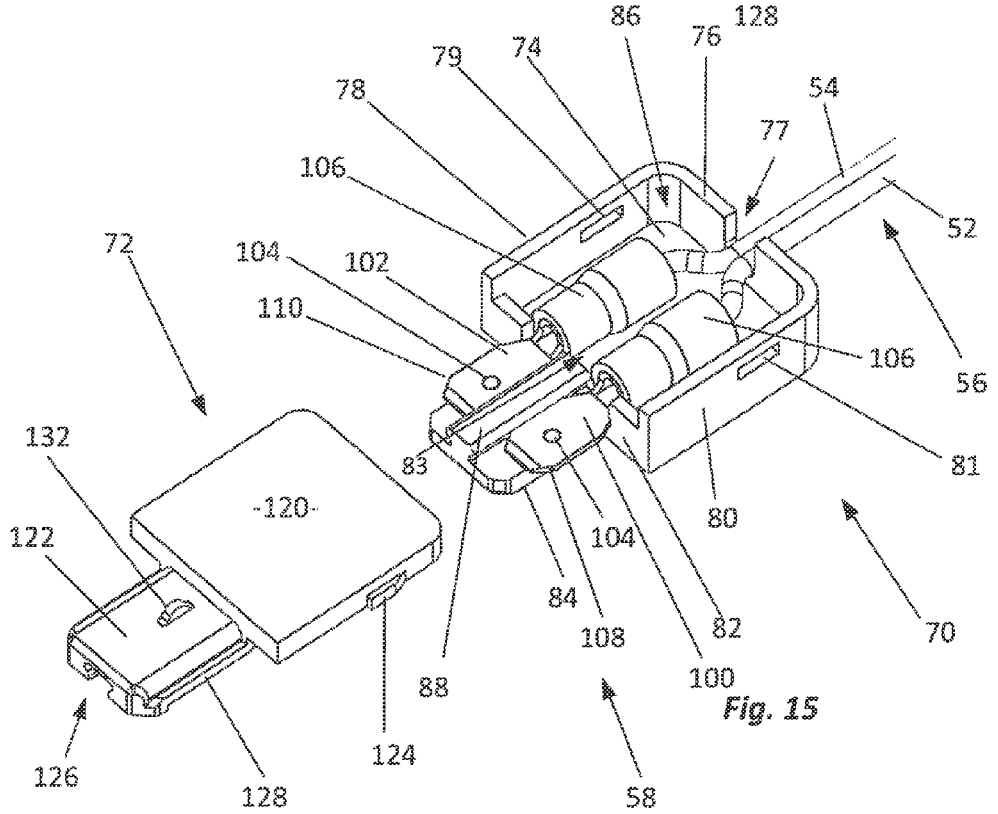
FIG. 15 is a perspective view showing the housing of the connector of the present assembly disassembled from the cover of the connector.
Figure 16:
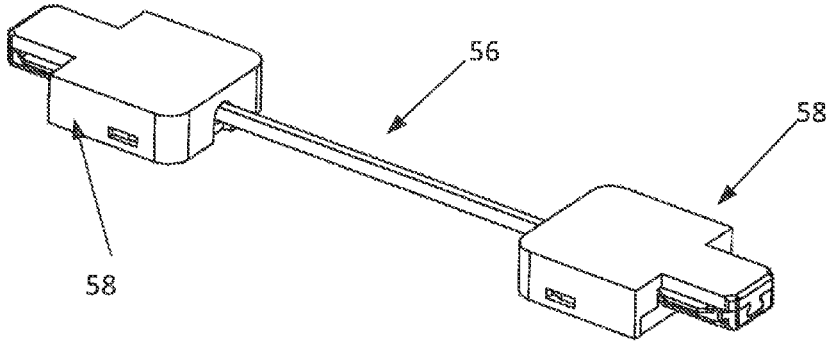
FIG. 16 is a perspective view of a wiring harness used to secure two pieces of track together.
Figure 17:
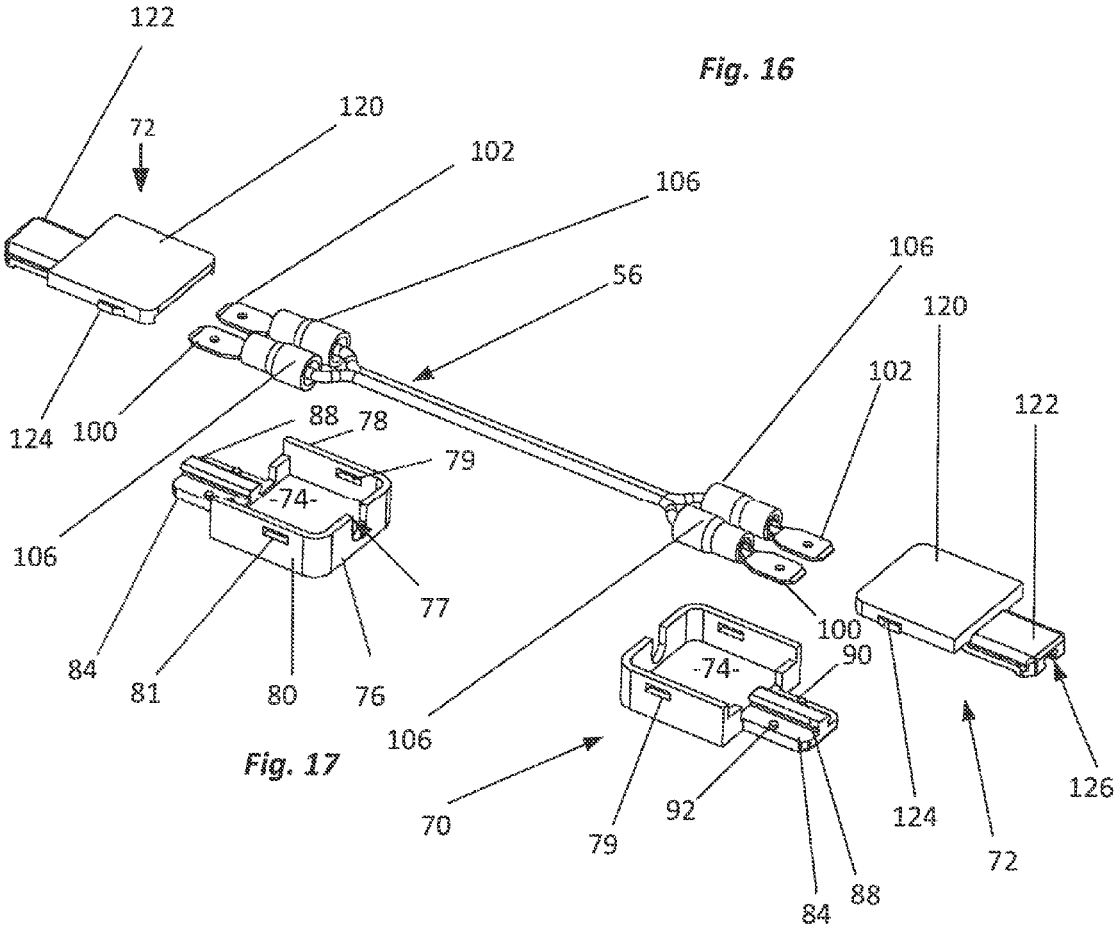
FIG. 17 is a perspective view of the arrangement shown in FIG. 16 but with the wiring harness disassembled.

As best shown in FIGS. 14, 15 and 17, the connectors 58 comprise a molded plastic housing 70 and a cover 72. The connector housing comprises a base 74. Extending upwardly from the base is a proximal wall 76, a pair of sidewalls 78 and 80 and a distal wall 82. Extending forward from the distal wall 82 is a tongue 84. A chamber 86 is formed by the base 74 and the proximal, side and distal walls 76-82 of the connector housing 70. The proximal wall 76 includes an opening 77 through which the cable 56 may pass. The sidewalls 78 and 80 include lock openings 79 and 81. The distal wall includes an opening 83. The tongue 84 is external to the distal wall 82 in a direction opposed to the chamber 86. The tongue 84 includes an alignment rail 86 and non-conductive pins 90 and 92 projecting upwardly from the tongue 84.

As noted above, the cable 56 includes a positive conductor 52 and a negative conductor 54. The opposed ends of positive conductor 52 are connected, such as by soldering, to flat conductor tabs 100 and the opposed ends of conductor 54 are connected, such as by soldering or the like, to flat conductor tabs 102. Each flat conductor tab has a hole 104 extending through the tab. Strain reliefs 106 cover and support the connection between the conductors 52 and 54 and the conductor tabs 100 and 102.

As part of the assembly process, the ends of the cable 56 are inserted into the housings 70 of the connectors so that the cable passes through the opening 77 in the proximal wall 77 of the base 74, the strain reliefs 106 at one end of the cable reside within the chamber 86 of the housing and the flat conductor tabs 100 and 102 extend through the opening 83 in the distal wall and the holes 104 in the connector tabs 100 and 102 mate with respective pins 90 an 92 on the tongue 84. Further, the outside edge 108 of tab 100 and the outside edge 110 of tab 102 extend outwardly in opposite directions beyond the side edges of the tongue 84 when so assembled. When the flat conductor tabs 100 and 102 are over the pins 90 and 92 such that the pins 90 and 92 extend through the holes 104, the alignment rail 88 extends between the inside edges of the tabs 100 and 102 to prevent them from coming in contact with each other and a short circuit being formed.

The cover 72 of the connector housing 70 includes a chamber cover portion 120 and a tongue cover portion 122. Projecting from the sides of the chamber cover portion 120 are locking tabs 124 which mate with the lock openings 79 and 81 of the connector housing 70. Further, the tongue cover member 122 includes an alignment channel. 126 which mates with the alignment rail 88 such that the alignment rail 88, alignment channel 126, lock openings 79 and 81 and locking tabs 124 secure the cover 72 to the housing 70 to complete the assembly.

When so assembled, the strain reliefs 106 are locked within the chamber 86 and the conductor tabs 100 and 102 are locked in place by the pins 90 and 92 between the tongue 84 and the tongue cover member 122.

Extending outwardly from one side of the tongue cover member 126 (or alternatively tongue 84) is an alignment guide 128. This alignment guide ensures that the connector 58 is not inserted into the end of the track 42 upside down which could lead to a short circuit or cross-wiring. The ends of the track sections are made asymmetrical and cooperate with the alignment guide 128 to provide this advantage.

As illustrated in FIGS. 4-6 and 16-17, two connectors 58 are attached at opposite ends of the cable 56 to complete the construction of the wiring harness. One of the connectors is attached to rail portion 41 and the other is attached to rail portion 43. When so connected, independent electrical connections are made between the positive conductors 60 of the rail portions 41 and 43 via the positive conductor 52 and the positive conductor tabs 100 of the harness 50. Likewise, an electrical connection is made between the negative conductors 61 of the track portions 41 and 43 via the negative conductor 54 and the negative conductor tabs 102 of the harness 50. The alignment guides 128 of the connectors 58 prevent the connectors 58 from being inserted into either track portion 41 or track portion 43 upside down which would, of course, lead to cross-wiring in a short circuit.

In many cases, friction between the elements associated with the tongue portions of the connectors 58 and the channels 62 of the track portions 41 and 43 will prevent inadvertent disconnection or dislodgement of the wiring harness 50 from the track portions. To provide an additional measure of security, each track portion includes a hole 130 extending through the back of the track near the end of the track portion. Likewise, each connector includes an arch-shaped tab 132 extending outwardly from the tongue cover member 122 which engages the hole 130 when the connector is joined to the end of the rail portion to provide further engagement.

It should be clear from the foregoing the electrical assembly 50 provides a quick, easy and error-free method of creating a proper electrical connection between the track portions 41 and 43. Further, when the shelving assembly 10 is disassembled such that the panel 30 is removed, the electrical assembly comprising harness 50 will disconnect from one or both of the track sections 41 or 43 automatically and without damage to the track or the harness. There is no need for a person disassembling the shelf to disconnect the harness before taking the back of the shelving unit apart.

Figure 18:
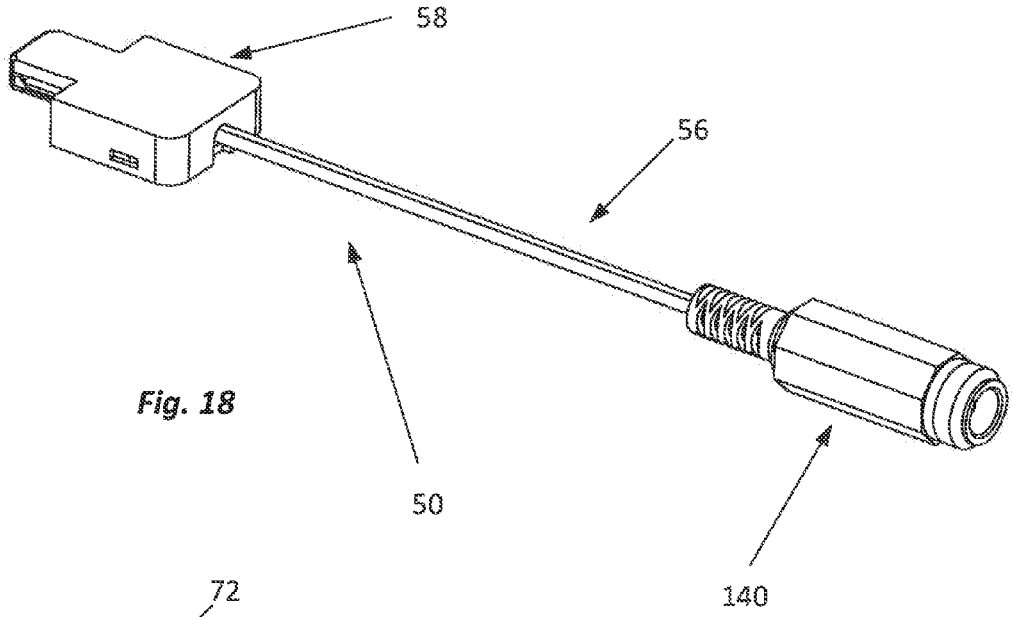
FIG. 18 shows an alternative wiring harness with a track connector at one end and an alternative connector at the other end which may be used to join the connector to a power supply or other device.
Figure 19:
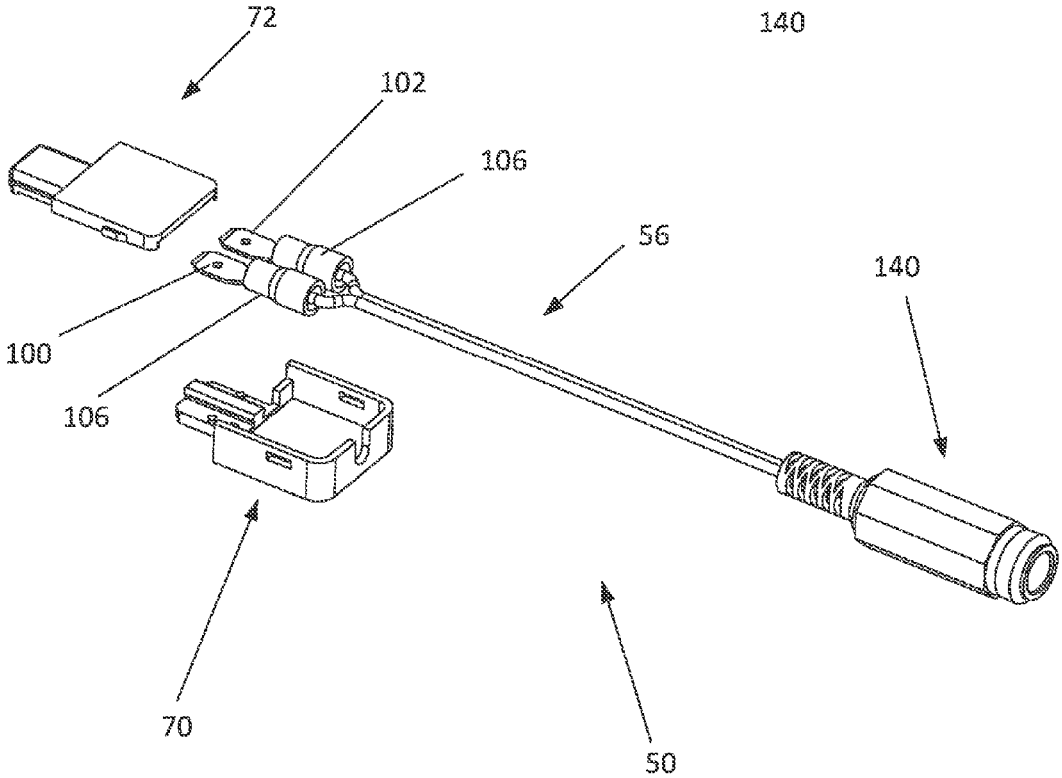
FIG. 19 is a perspective view of the arrangement shown in FIG. 18 but with the track connector disassembled.

Connectors such as 58 may be used with other electrical assemblies to attach other items to the track. 42. As shown in FIG. 3, one item typically coupled to the track is a power supply 44. Power supplies often include a pin-type connector designed to be coupled to a barrel jack. As shown in FIGS. 18 and 19, a harness can easily be formed with such a barrel jack 140 at one end and connector 58 of the present invention at the opposite end, enabling the power supply 44 to be quickly and easily coupled to the track in an error-free manner.

Figure 20:
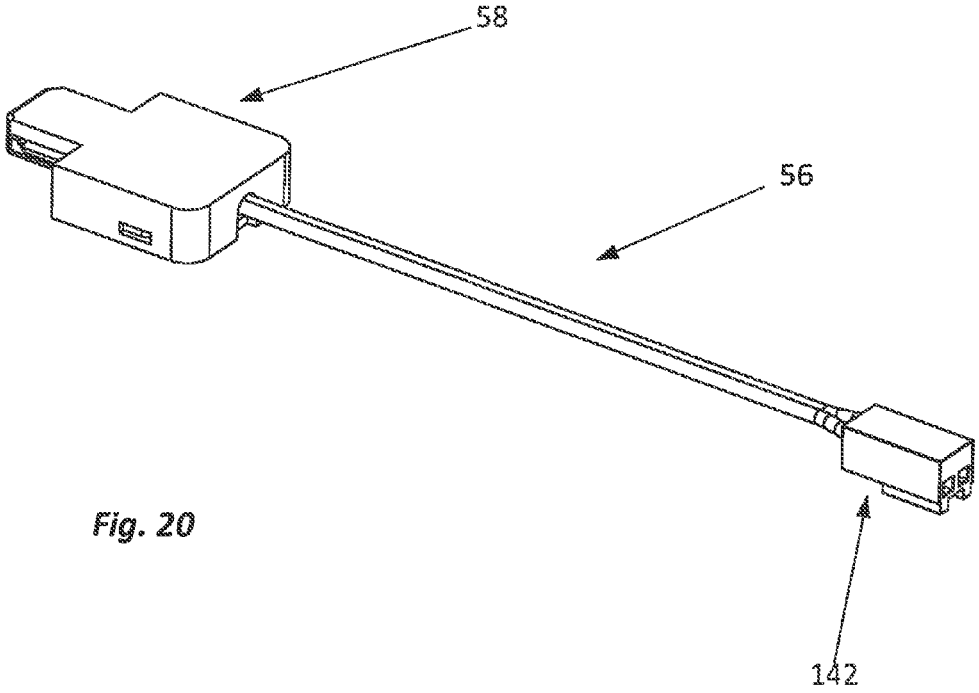
FIG. 20 shows a wiring harness using the same track connector, but with a different connector to join the wiring harness to an electrical device.
Figure 21:
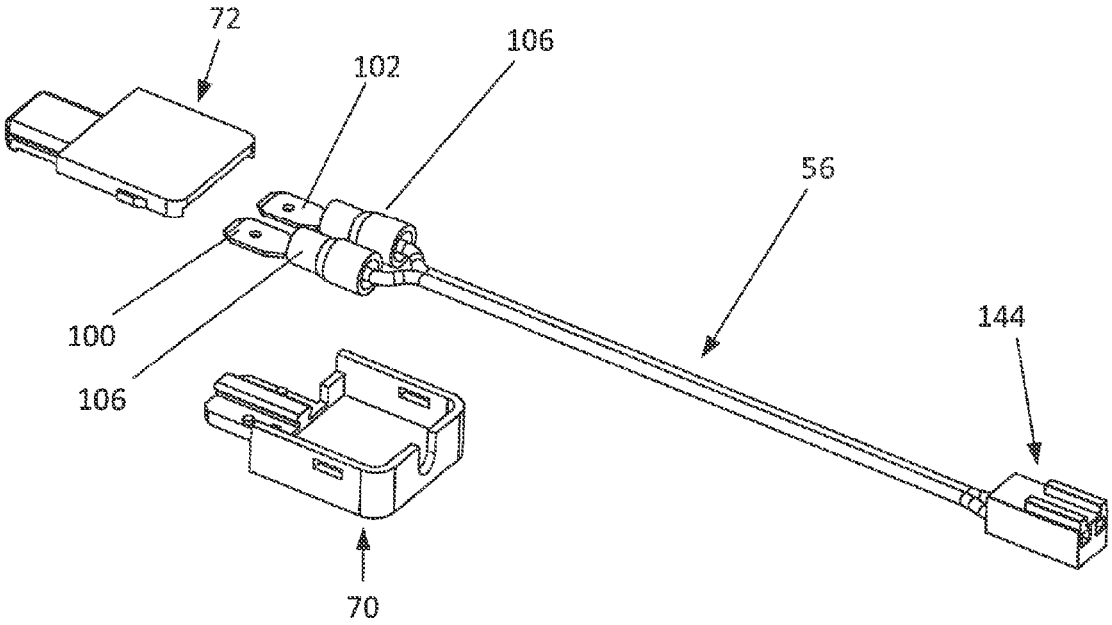
FIG. 21 shows the same arrangement shown in FIG. 20 but with the track connector disassembled.

Other power supplies incorporate other types of connectors. FIGS. 20 and 21 show a harness incorporating the connector 58 to the present invention at one end and an alternative power supply connector 142 at the opposite end.

Figure 22:
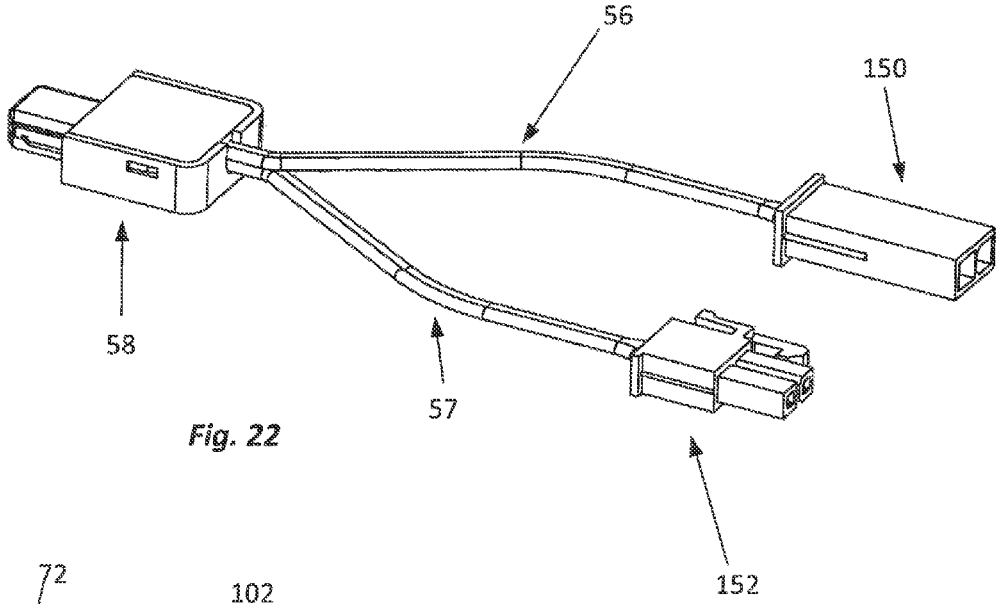
FIG. 22 shows a wiring harness comprising a track connector and a pair of connectors, one male and one female, used to join one or a pair of electrical devices to a section of track.
Figure 23:
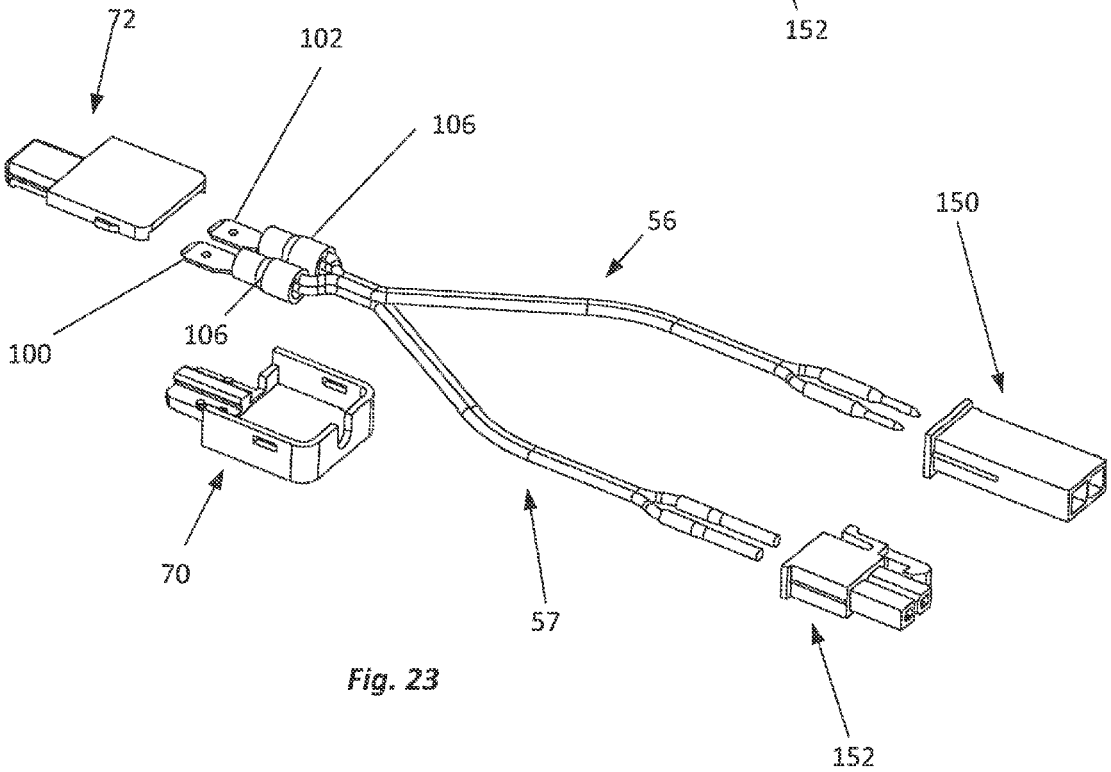
FIG. 23 shows the same arrangement as FIG. 22 but with the track connector disassembled.

Sometimes it is desirable to attach a pair of electrical devices to a track or, alternatively, supply power from a single power supply to a plurality of tracks. FIGS. 22 and 23 illustrate harnesses which incorporate the track connector 58 of the present invention with a pair of cables, one cable 56 attached at its opposite ends and to a female Molex connector and the other cable 57 attached at its opposite end to a male Molex connector. FIGS. 18-23 are provided to demonstrate that the connector 58 of the present invention has multiple applications when forming harnesses and the opposite end of the cable can be joined to the identical connector or to any of a variety of alternative connectors, those shown in FIGS. 18-23 merely illustrating some of the multitude of options which are available.

From the foregoing, it will be appreciated that although specific examples have been described herein for purposes of illustration, various modifications may he made without deviating from the spirit and scope of this disclosure. By way of example, wiring harnesses may be formed using the connector of the present invention which includes one, two or even more cables with any of a number of different connectors attached to the opposite ends of the cables. Likewise, the harnesses may be colored to match the shelving with which they are used to hide them from view. Alternatively, the harnesses, connectors or cables may be color coded to meet the needs of a specific application. Likewise, various indicia may be provided on the connector of the present invention. Such indicia may be in the form of written labeling or ridges or the like formed in the connector housing 70 or connector cover 72. Likewise, the materials used to form various components may vary depending on the particular application. For example, the gauge of the wire used in the cabling may be altered and the material used as conductive elements in the cable may be altered depending on the cost of raw materials. Examples of such conductive materials include aluminum or copper. The cable, of course, will be provided with a non-conductive sheath to prevent a short circuit from being created between the conductive elements and the shelving components which are typically made of metal. Likewise, the housing and cover of the connectors 58 can be made out of any of a variety of non-conductive plastics or other non-conductive materials. It is, therefore, intended that the foregoing detailed description be regarded as illustrative rather than limiting, and that it be understood that it is the following claims, including all equivalents, that are intended to identify the invention.

What is claimed is:

1. A electrical assembly comprising:

a. a cable having a first end and a second end and comprising a first electrically insulated conductor and a second electrically insulated conductor running the length of the cable between the first and second ends, b. a first flat conductor tab having an outside edge, with a hole extending through the first flat conductor tab, and joined to the first electrically insulated conductor at a first joint, c. a second flat conductor tab having an outside edge, with a hole extending through the second flat conductor tab, and joined to the second electrically insulated conductor at a second joint, wherein the first joint and the second joint are each located at the first end of the cable, d. a first strain relief adapted to surround and secure the first joint and a second strain relief adapted to surround and secure the second joint, e. a housing comprising a base and proximal, distal and opposing side walls extending from the base and forming an open chamber adapted to contain the first strain relief and the second strain relief, an opening in the proximal wall through which the first and second insulated conductors of the cable are adapted to pass, a lock opening in each of the side walls, an opening in the distal wall through which the first and second flat conductor tabs are adapted to pass, a tongue projecting from the distal wall away from the chamber, an alignment rail projecting in a first direction from the tongue, a first pin projecting in the first direction from the tongue on a first side of the alignment rail to a free end, and a second pin projecting in the first direction from the tongue on second side of the alignment rail to a free end, the free end of the first pin adapted to be inserted through the hole of the first flat conductor tab and the free end of the second pin adapted to be inserted through the hole of the second flat conductor tab;

f. a cover including a chamber cover portion and a tongue cover portion, the chamber cover portion adapted to close the open chamber of the housing and including locking tabs adapted to engage the lock openings in the side walls of the housing, the tongue cover portion adapted to cover the free ends of the first pin and the second pin and including an alignment channel adapted to receive the alignment rail of the tongue, wherein with the cover cooperates with the housing to retain the cable within the opening in the proximal wall, the first strain relief and the second strain relief within the chamber, the first flat conductor tab on the first pin and the second conductor tab on the second pin with the outside edge of the first conductor tab projecting outwardly in a first direction from the tongue and tongue cover portion and the outside edge of the second conductor tab projecting outwardly from the tongue and tongue cover in a second direction opposite of the first direction; and g. an alignment guide extending from the tongue or tongue cover in either the first or second direction.

2. The wiring harness of claim 1 wherein the cover further includes an arch shaped tab projecting from the tongue cover portion in a direction away from the alignment channel.

3. The wiring harness of claim 1 wherein the cable includes a third electrically insulated conductor coupled to the first flat conductor tab and a fourth electrically insulated conductor coupled to the second flat conductor tab.

4. The wiring harness of claim 1 wherein a connector is attached to the second end of the cable.

5. The wiring harness of claim 3 wherein a male connector is attached to the first electrically insulated conductor and the second insulated conductor and a female connector is attached to the third electrically insulated conductor and the fourth insulated conductor.

6. The wiring harness of claim 1 further including:

a. a third flat conductor tab having an outside edge, with a hole extending through the third flat conductor tab, and joined to the first electrically insulated conductor at a third joint, b. a fourth flat conductor tab having an outside edge, with a hole extending through the fourth flat conductor tab, and joined to the second electrically insulated conductor at a fourth joint, wherein the third joint and the fourth joint are each located at the second end of the cable, c. a third strain relief adapted to surround and secure the third joint and a fourth strain relief adapted to surround and secure the fourth joint, d. a second housing comprising a base and proximal, distal and opposing side walls extending from the base and forming an open chamber adapted to contain the third strain relief and the fourth strain relief, an opening in the proximal wall through which the first insulated conductor and the second insulated conductor of the cable are adapted to pass, a lock opening in each of the side walls, an opening in the distal wall through which the third and fourth flat conductor tabs are adapted to pass, a tongue projecting from the distal wall away from the chamber, an alignment rail projecting in a first direction from the tongue, a first pin projecting in the first direction from the tongue on a first side of the alignment rail to a free end, and a second pin projecting in the first direction from the tongue on second side of the alignment rail to a free end, the free end of the first pin adapted to be inserted through the hole of the third flat conductor tab and the free end of the second pin adapted to be inserted through the hole of the fourth flat conductor tab;

e. a second cover including a chamber cover portion and a tongue cover portion, the chamber cover portion adapted to close the open chamber of the second housing and including locking tabs adapted to engage the lock openings in the side walls of the second housing, the tongue cover portion adapted to cover ends of the first and second pins of the second housing and including an alignment channel adapted to receive the alignment rail of the tongue of the second housing, wherein with the second cover cooperates with the second housing to retain the cable in the opening in the proximal wall of the second housing, the third strain relief and the fourth strain relief within the chamber of the second housing, the third flat conductor tab on the first pin and the second conductor tab on the second pin of the second housing with the outside edge of the third conductor tab projecting outwardly in a first direction from the tongue and tongue cover portion and the outside edge of the fourth conductor tab projecting outwardly from the tongue and tongue cover in a second direction opposite of the first direction; and f. a second alignment guide projecting from the tongue or tongue cover in either the first or second direction.

7. An electrical assembly comprising at least one track section having an open end of a non-symmetrical shape, an elongate open channel running the length of the track section, a first conductor member on one side of the open channel extending the length of the track section, and a second conductor member on the other side of the open channel extending the length of the track section, and a wiring harness comprising:

a. a cable having first and second ends and a first electrically insulated conductor and a second electrically insulated conductor running the length of the cable between the first and second ends, b. a first connector assembly coupled to the first end of the cable and comprising, i. a first fat conductor tab having an outside edge, with a hole extending through the first flat conductor tab, and joined to the first electrically insulated conductor at a first joint, ii. a second flat conductor tab having an outside edge, with a hole extending through the second flat conductor tab, and joined to the second electrically insulated conductor at a second joint, wherein the first joint and the second joint are located at the first end of the cable, iii. a first strain relief adapted to surround and secure the first joint and a second strain relief adapted to surround and secure the second joint, iv. a housing comprising a base and proximal, distal and opposing side walls extending from the base forming an open chamber adapted to contain the first strain relief and the second strain relief, an opening in the proximal wall through which the first insulated conductor and the second insulated conductor of the cable is adapted to pass, a lock opening in each of the side walls, an opening in the distal wall through which the first and second flat conductor tabs are adapted to pass, a tongue projecting from the distal wall away from the chamber, an alignment rail projecting in a first direction from the tongue, a first pin projecting in the first direction from the tongue on a first side of the alignment rail, and a second pin projecting in the first direction from the tongue on second side of the alignment rail, the first pin adapted to be inserted into the hole of the first flat conductor tab and the second pin adapted to be inserted into the hole of the second flat conductor tab;

v. a cover including a chamber cover portion and a tongue cover portion, the chamber cover portion adapted to close the open chamber of the housing and including locking tabs adapted to engage the lock openings in the side walls of the housing, the tongue cover portion adapted to cover ends of the pins and including an alignment channel adapted to receive the tongue, wherein with the cover cooperates with the housing to retain the cable in the opening in the proximal wall, the first strain relief and the second strain relief within the chamber, the first flat conductor tab on the first pin and the second conductor tab on the second pin with the outside edge of the first conductor tab projecting outwardly in a first direction from the tongue and tongue cover portion and the outside edge of the second conductor tab projecting outwardly from the tongue and tongue cover in a second direction opposite of the first direction; and vi. an alignment guide from the tongue or tongue cover in either the first or second direction, wherein said alignment guide is adapted to cooperate with the non-symmetrical shape of the end of the track section to ensure that when the first connector assembly is inserted into the open end of the track sections, an electrical path is formed between the first conductor of the track section and the first electrically insulated conductor of the cable and a further electrical path is formed between the second conductor of the track section and the second electrically insulated conductor of the cable.

8. The electrical assembly of claim 7 wherein said at least one track section has a second open end and the electrical assembly further includes a cap made of an electrically non-conductive material covering the second open end.

9. The electrical assembly of claim 8 wherein the cap comprises a body adapted to cover the end of the track section and a tongue projecting from the body, said tongue having and alignment guide and adapted to be inserted into the channel of the track section through the second open end of the track section to couple the cap to the track section.

10. The electrical assembly of claim 7 further comprising a second connector assembly coupled to the second end of the cable.

11. The electrical assembly of claim 10 wherein said second connector is adapted to be coupled to a power supply for supplying electrical power to the track section.

12. The electrical assembly of claim 10 wherein said second connector assembly is adapted to be coupled to a second track section.

13. The electrical assembly of claim 10 wherein said second connector assembly is identical to the first connector assembly.

14. The electrical assembly of claim 7 having a third positive electrically insulated conductor joined to the first flat conductor tab at the first joint and a fourth electrically insulated conductor joined to the second flat conductor tab at the second joint.

15. The electrical assembly of claim 14 further including a second connector assembly coupled to the first electrically insulated conductor and the second electrically insulated conductor, and a third connector assembly coupled to the third positive electrically insulated conductor and the fourth electrically insulated conductor.

16. The electrical assembly of claim 15 wherein at least one of the second and third connector assemblies is identical to the first connector assembly.

17. An electrical assembly comprising first and second track section, each track section having an open end of a non-symmetrical shape, and elongate open channel running the length of the track section, a first conductive member on one side of the open channel extending the length of the track section, and a second conductive member on the ocher side of the open channel extending the length of the track section, and a wiring harness comprising:

a. a cable having first and second ends and a first electrically insulated conductor and a second electrically insulated conductor running the length of the cable between the first and second ends, b. a first connector assembly coupled to the first end of the cable and comprising, i. a first flat conductor tab having an outside edge, with a hole extending through the first flat conductor tab, and joined to the first electrically insulated conductor at a first joint, ii. a second flat conductor tab having an outside edge, with a hole extending through the second flat conductor tab, and joined to the second electrically insulated conductor at a second joint, wherein the first joint and the second joint are located at the first end of the cable, iii. a first strain relief adapted to surround and secure the first joint and a second strain relief adapted to surround and secure the second joint, iv. a housing comprising a base and proximal, distal and opposing side walls extending from the base forming an open chamber adapted to contain the first strain relief and the second strain relief, an opening in the proximal wall through which the first insulated conductor and the second insulated conductor of the cable is adapted to pass, a lock opening in each of the side walls, an opening in the distal wall through which the first and second flat conductor tabs are adapted to pass, a tongue projecting from the distal wall away from the chamber, an alignment rail projecting in a first direction from the tongue, a first pin projecting in the first direction from the tongue on a first side of the alignment rail, and a second in projecting in the first direction from the tongue on second side of the alignment rail, the first pin adapted to be inserted into the hole of the first flat conductor tab and the second pin adapted to be inserted into the hole of the second flat conductor tab;

v. a cover including a chamber cover portion and a tongue cover portion, the chamber cover portion adapted to close the open chamber of the housing and including locking tabs adapted to engage the lock openings in the side walls of the housing, the tongue cover portion adapted to cover ends of the pins and including an alignment channel adapted to receive the tongue, wherein with the cover cooperates with the housing to retain the cable in the opening in the proximal wall, the first strain relief and the second strain relief within, the chamber, the first flat conductor tab on the first pin and the second conductor tab on the second pin with the outside edge of the first conductor tab projecting outwardly in a first direction from the tongue and tongue cover portion and the outside edge of the second conductor tab projecting outwardly from the tongue and tongue cover in a second direction opposite of the first direction; and vi. an alignment guide from the tongue or tongue cover in either the first or second direction, c. a second connector assembly coupled to the second end of the cable and comprising, i. a third flat conductor tab having an outside edge, with a hole extending through the third flat conductor tab, and joined to the first electrically insulated conductor at a third joint, ii. a fourth flat conductor tab having an outside edge, with a hole extending through the fourth flat conductor tab, and joined to the second electrically insulated conductor at a fourth joint, wherein the third joint and the fourth joint are located at the second end of the cable, iii. a third strain relief adapted to surround and secure the third joint and a fourth strain relief adapted to surround and secure the fourth joint, iv. a second housing comprising a base and proximal, distal and opposing side walls extending from the base forming an open chamber adapted to contain the third strain relief and the fourth strain relief, an opening in the proximal wall through which the first and second insulated conductors of the cable are adapted to pass, a lock opening in each of the side walls, an opening in the distal wall through which the third and fourth flat conductor tabs are adapted to pass, a tongue projecting from the distal wall away from the chamber, an alignment rail projecting in a first direction from the tongue, a first pin projecting in the first direction from the tongue on a first side of the alignment rail, and a second pin projecting in the first direction from the tongue on second side of the alignment rail, the first pin adapted to be inserted into the hole of the third flat conductor tab and the second pin adapted to be inserted into the hole of the fourth flat conductor tab;

v. a second cover including a chamber cover portion and a tongue cover portion, the chamber cover portion adapted to close the open chamber of the second housing and including locking tabs adapted to engage the lock openings in the side wails of the second housing, the tongue cover portion adapted to cover ends of the pins of the second housing and including an alignment channel adapted to receive the tongue of the second housing, wherein with the second cover cooperates with the second housing to retain the cable in the opening in the proximal wall of the second housing, the third strain relief and the fourth strain relief within the chamber of the second housing, the third flat conductor tab on the first pin and the second conductor tab on the second pin of the second housing with the outside edge of the third conductor tab projecting outwardly in a first direction from the tongue and tongue cover portion and the outside edge of the fourth conductor tab projecting outwardly from the tongue and tongue cover in a second direction opposite of the first direction; and vi. a second alignment guide projecting from the tongue or tongue cover in either the first or second direction, wherein said first and second alignment guides are adapted to cooperate with the non-symmetrical shape of the ends of the track sections to ensure that when the first connector assembly and the second connector assembly are inserted into the open ends of the track sections, a first electrical path is formed between the first conductive member of the track sections and the first electrically insulated conductor of the cable and a second electrical path is formed between the second conductive member of the track sections and the second electrically insulated conductor of the cable.

18. The electrical assembly of claim 17 wherein the housings and covers of the first and second connector assemblies are made out of non-conductive plastic.

19. The electrical assembly of claim 17 wherein the covers of the first and second connector assemblies each include an arch shaped tab projecting from the tongue cover portion in a direction away from the alignment channel.

20. The electrical assembly of claim 19 wherein each of the track sections has a back and a hole through the back adjacent the end of the track sections adapted to receive one of the arch shaped tabs.

* * * * *

UNITED STATES PATENT AND TRADEMARK OFFICE

CERTIFICATE OF CORRECTION

PATENT NO. : 9,057,513 B2
APPLICATION NO. : 14/027704
DATED : June 16, 2015
INVENTOR(S) : Thomas G. Lindblom et al.

It is certified that error appears in the above-identified patent and that said Letters Patent is hereby corrected as shown below:

IN THE CLAIMS

In claim 7(b)(i), column 9, line 10, delete the word “fat” and insert the word -- flat --.

In claim 17(b)(iv), column 11, line 12, delete the word “in” and insert the word -- pin --.

Signed and Sealed this
Sixth Day of October, 2015

Michelle K. Lee

Michelle K. Lee
*Director of the United States Patent and Trademark Office*